United States Patent [19]

Shekleton

[11] Patent Number: 4,949,545

[45] Date of Patent: Aug. 21, 1990

[54] TURBINE WHEEL AND NOZZLE COOLING

[75] Inventor: Jack R. Shekleton, San Diego, Calif.

[73] Assignee: Sundstrand Corporation, Rockford, Ill.

[21] Appl. No.: 283,078

[22] Filed: Dec. 12, 1988

[51] Int. Cl.[5] ..... F23R 3/08; F23R 3/14

[52] U.S. Cl. ..... 60/756; 60/39.36; 60/757

[58] Field of Search ..... 60/39.36, 39.75, 39.83, 60/758, 759, 760, 757, 752

[56] References Cited

U.S. PATENT DOCUMENTS

| | | | |
|---|---|---|---|
| 3,383,855 | 5/1968 | Freeman et al. | 60/760 |
| 3,613,360 | 10/1971 | Howes | 60/39.36 |
| 3,623,318 | 11/1971 | Shank | 60/39.36 |
| 3,869,864 | 3/1975 | Bunn | 60/760 |
| 4,794,754 | 1/1989 | Shekleton et al. | 60/760 |
| 4,825,640 | 5/1989 | Shekleton | 60/752 |

*Primary Examiner*—Louis J. Casaregola
*Assistant Examiner*—Timothy S. Thorpe
*Attorney, Agent, or Firm*—Wood, Phillips, Mason, Recktenwald & Vansanten

[57] ABSTRACT

Problems involving the cooling of a front turbine shroud having a radial section 110 and an axial section 112 connected by a radius 114 and employed in a turbine engine are minimized or eliminated by telescoping the radially outer wall 34 of an annular combustor 26 into the axial section 112 and radially spacing the same inwardly therefrom. An inlet 128 in fluid communication with the compressed air source of the turbine extends to a swirling strip 130 which between the radially outer wall 34 and the axial section 112 and generates a film of cooling air and applies it to the radius 114 of the front shroud 27 to cool the same.

7 Claims, 2 Drawing Sheets

TURBINE WHEEL AND NOZZLE COOLING

FIELD OF THE INVENTION

This invention relates to gas turbines, and more particularly, to an improved means of providing cooling for turbine nozzle components and of the turbine wheel itself.

BACKGROUND OF THE INVENTION

It has long been known that achieving uniform circumferential turbine inlet temperature distribution in gas turbines is highly desirable. Uniform distribution minimizes hot spots and cold spots to maximize efficiency of operation. In addition, uniform distribution prolongs the life of those turbine components that are exposed to the hot gases.

To achieve uniform turbine inlet temperature distribution in gas turbines having annular combustors, heretofore one has had to provide a large number of fuel injectors to assure that the fuel is uniformly distributed in the combustion air about the annular combustor. Fuel injectors are quite expensive with the consequence that the use of a large number of them is not economically satisfactory. As the number of fuel injectors in a system is increased, with unchanged fuel consumption, the fuel flow area in each injector becomes smaller and thus, more prone to clogging.

This in turn creates the very problem, nonuniform temperature distribution sought to be done away with.

Furthermore, in relatively small turbine engines, wherein relatively low fuel flow rates may be encountered, it is highly desirable to minimize the number of the fuel injectors to minimize the possibility of clogging.

To avoid this difficulty, the prior art has suggested that fuel be injected into annular combustion chambers with some sort of a tangential component. The resulting swirl of fuel and combustion supporting gas provides a much more uniform mix of fuel with the air to provide a more uniform burn and thus achieves more circumferential uniformity in the turbine inlet temperature. However, this solution deals only with minimizing the presence of hot and/or cold spots and does not focus on the remaining problem where gases of combustion may impinge upon components in a uniform manner but at excessive temperatures.

The present invention is directed to overcoming one or more of the above problems.

SUMMARY OF THE INVENTION

It is the principal object of the invention to provide a new and improved gas turbine. More specifically, it is an object of the invention to provide such a turbine wherein good cooling is provided for the turbine nozzle and turbine wheel structures.

An exemplary embodiment of the invention achieves the foregoing object in a gas turbine construction including a rotor having compressor blades and turbine blades. An inlet is adjacent one side of the compressor blades and a diffuser adjacent the other side of the compressor blades. A nozzle including front and rear shrouds is located adjacent the turbine blades for directing hot gases at the turbine blades to cause rotation of the rotor. An annular combustor is disposed about the rotor and has an outlet to the nozzle along with an inner wall, an outer wall spaced therefrom and a connecting radial wall. Means are located on the radially outer wall at the outlet for establishing a cooling air stream on the front shroud of the nozzle.

In a preferred embodiment, the front shroud includes a radial section having its outer extremity joined to an axial section by a relatively small radius and the establishing means is located at the junction of the radius and the axial section.

The invention contemplates that the establishing means comprise a series of discharge openings in fluid communication with the diffuser and skewed axially so as to impart swirl to the cooling air stream. In this embodiment of the invention it is considered that a fuel air mixture will be injected tangentially into the combustor to create a swirl of combustion gases therein and the swirling cooling air is injected in the same direction as the direction of fuel injection.

According to a highly preferred embodiment of the invention, the axial section and the radially outer wall are telescoped and radially spaced with the establishing means including slot defining means carried by one or the other of the axial section and the radially outer wall in the space between them. The downstream ends of the slots thus define the discharge openings for the cooling air stream.

In a highly preferred embodiment, the slot defining means are spaced axially from the outlet to provide a wake minimizing zone between the axial section and the radially outer wall and downstream of the discharge opening so that a uniform film of air impinges upon the front shroud.

Preferably, the air stream establishing means is located at or about the beginning of the radius interconnecting the axial and radial sections of the shroud.

Other objects and advantages will become apparent from the following specification taken in connection with the accompanying drawings.

DESCRIPTION OF THE PREFERRED EMBODIMENT

Figure 1:
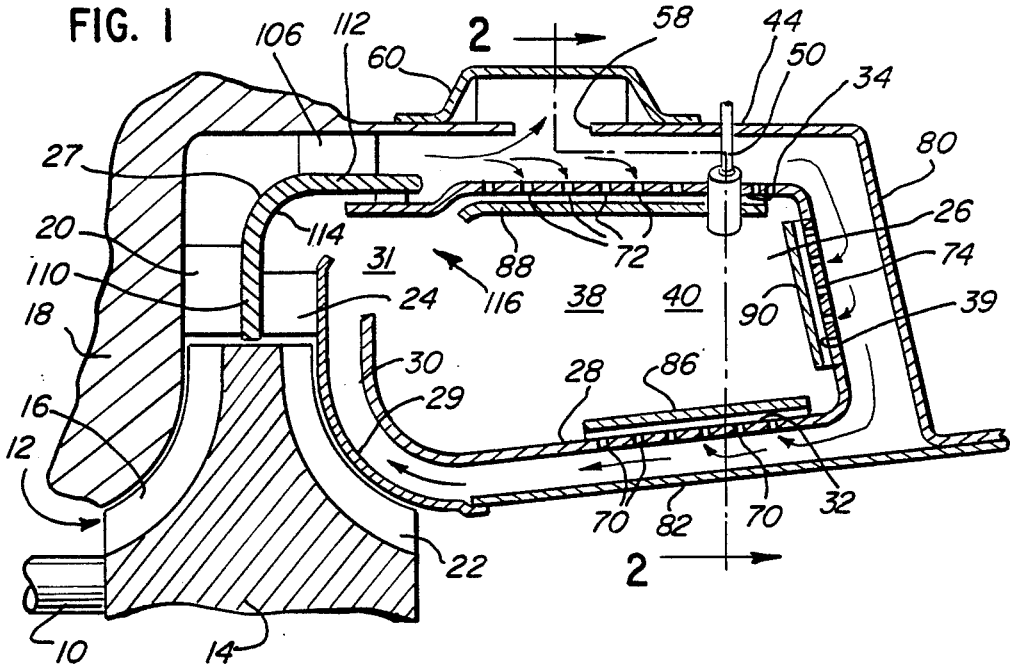
FIG. 1 is a somewhat schematic, fragmentary, sectional view of a turbine made according to the invention.

An exemplary embodiment of a gas turbine engine made according to the invention is illustrated in the form of a radial flow gas turbine including a rotary shaft 10 journaled by bearings not shown. Adjacent one end of the shaft 10 is an air inlet area 12 through which air to support combustion is introduced into the engine. The shaft 10 mounts a rotor, generally designated 14, which may be of conventional construction. Accordingly, the same includes a plurality of compressor blades 16 adjacent the inlet 12 and located on a rotary compressor wheel 17. A compressor blade shroud 18 is provided in adjacency thereto and just radially outwardly of the radially outer extremities of the compressor blades 16 is a conventional diffuser 20.

Oppositely of the compressor blades 16, a turbine wheel 21 forming part of the rotor 14 has a plurality of turbine blades 22 and just radially outwardly of the turbine blades 22 is an annular nozzle including vanes or blades 24. The nozzle is adapted to receive hot gasses of combustion from a combustor, generally designated 26. The nozzle vanes 24 extend between a front turbine wheel shroud 27 and a rear turbine wheel shroud 29.

The compressor system including the blades 16, the shroud 18, and the diffuser 20 delivers compressed air to the combustor 26 and about the same through a passage 30 to an outlet 31 of the combustor 26. That is to say, hot gasses of combustion from the combustor 26 as well as dilution air are directed via the nozzle vanes 24 against the turbine wheel blades 22 to cause rotation of the rotor 14 and thus the shaft 10. The latter may be, of course, coupled to some sort of apparatus requiring the performance of useful work or the turbine may be utilized for the generation of thrust.

In any event, the rear shroud 29 is located so as to close off the flow path from the nozzle blades 24 and confine the expanding gasses to the area of the turbine blades 22 whereas the front shroud 27 is to direct the gasses of combustion and dilution air from the outlet 31 radially inward to the blades 24.

The combustor 26 has a generally cylindrical inner wall 32 and a generally cylindrical outer wall 34. The two thus define an interior annulus 38 which is closed at the end opposite the outlet 31 by means of a radially extending wall 39.

Oppositely of the outlet 31, and adjacent the wall 39, the interior annulus 38 of the combustor 26 includes a primary combustion zone 40. It is in this zone in which the burning of fuel primarily occurs. Other combustion may, in some instance, occur downstream from the primary combustion area 40 in the direction of the outlet 31 and provision is made for the injection of dilution air to the outlets 31 to mix with and cool the gasses of combustion to a temperature suitable for application to the blades 22 of the turbine as well as surrounding components including the nozzle vanes 24 and the shrouds 27 and 29. It should be noted that the assembly is configured so that the vast majority of dilution air goes entirely about the combustor 26 and through the passage 30 to provide convective cooling of the combustor walls and avoid the formation of hot spots thereon.

Figure 2:
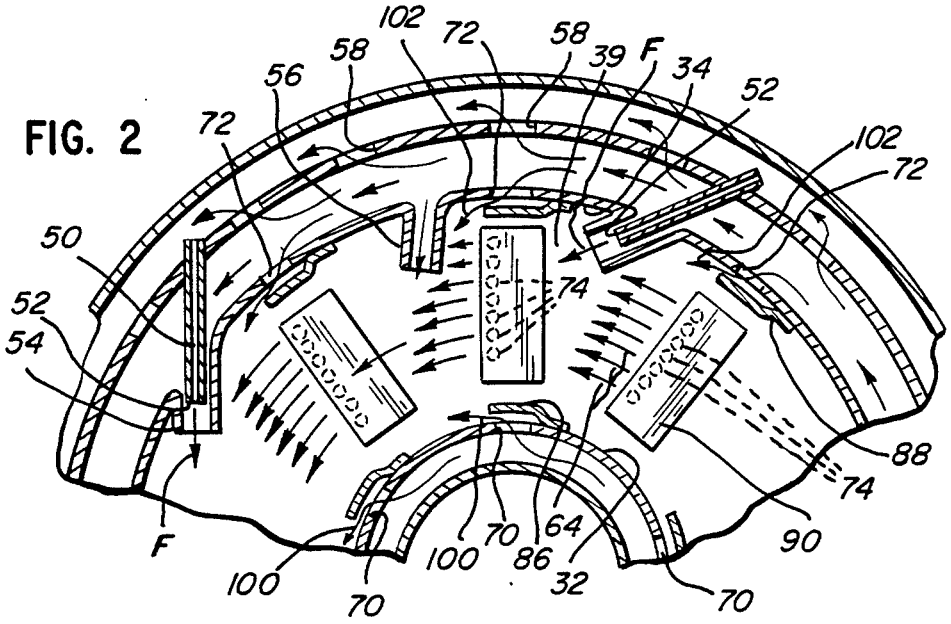
FIG. 2 is a fragmentary sectional view taken approximately along the line 2—2 in FIG. 1.

A further wall 44 is generally concentric to the walls 32 and 34 and is located radially outward of the latter. The same extends to the outlet of the diffuser 20 and thus serves to contain and direct compressed air from the compressor system to the combustor 26. As best seen in FIG. 2, the combustor 26 is provided with a plurality of fuel injection nozzles 50. The fuel injection nozzles 50 have ends 52 disposed within the primary combustion zone 40 and are configured to be nominally tangential to the inner wall 32 or at least the annulus 38. The fuel injection nozzles 50 generally, but not necessarily, utilize the pressure drop of fuel across swirl generating orifices (not shown) to accomplish fuel atomization. Tubes 54 surround the nozzles 50 and high velocity air from the compressor flows through the tubes 54 to enhance fuel atomization. Thus, the tubes 54 serve as air injection tubes and the high velocity air flowing through the tubes 54 may be the sole means by which fuel exiting the nozzles 50 is atomized if desired. The tubes 54 are also configured to be nominally tangential to the inner wall 32 or at least to the annulus 38.

The nozzles 50 are equally angularly spaced about the annulus 40 and optionally disposed between each pair of adjacent nozzles 50 may be a combustion supporting air jet 56. When used, the jets 56 are located in the wall 34 and establish fluid communication between the air delivery annulus defined by the walls 34 and 44 and the primary combustion annulus 40. These jets 56 may be somewhat colloquially turned "bender" jets as will appear. Preferably, the injectors 50 and jets 56 are coplanar or in relatively closely spaced planes remote from the outlet area 36. Such plane or planes are transverse to the axis of the shaft 10.

When the intended use of the engine requires the delivery of large quantities of bleed air, the wall 44 is provided with a series of outlet openings 58 which in turn are surrounded by a bleed air scroll 60 secured to the outer surface of the wall 44. Thus, bleed air to be used for conventional purposes may be made available at an outlet (not shown) from the scroll 60.

To prevent the formation of undesirable hot spots on the walls 32, 34 and 39 for any of a variety of reasons, means are provided for flowing a cooling air film over the walls 32, 34 and 39 on the surfaces thereof facing the annulus 38. This air film is injected into the annulus 38 in a generally tangential, as opposed to axial, direction. Preferably, the injection is provided along each of the walls 32, 34 and 39 but in some instances, such injection may incur on less than all of such walls as desired, particularly when a passage such as the passage 30 is utilized and extends completely about the combustor 26.

In the case of the radially inner wall 32, the same is provided with a series of apertures 70. Preferably the apertures 70 are arranged in a series of equally angularly spaced generally axial extending rows. Thus, the three apertures 70 shown in FIG. 2 constitute one aperture in each of three rows while the apertures 70 illustrated in FIG. 1 constitute the apertures in a single row. A similar series of equally angularly spaced axially extending rows of apertures 72 is likewise provided in the wall 34.

Similarly, in the case of the wall 39, there are a series of generally radially extending rows of apertures 74. As can be readily appreciated, the apertures 70, 72 and 74 establish fluid communication between the annulus defined by the wall 44 and the wall 34, a radially extending annulus defined by the wall 39 and a wall 80 connected to the wall 44 and the connecting annulus defined by the wall 32 and a connecting wall 82. The tangential and film-like streams of cooling air enter the annulus through the openings 70, 72 and 74, and cooling strips 86, 88 and 90 are applied respectively to the walls 32, 24 and 39 for each row of the openings. As a consequence of this construction, the air flowing in the annuli about the combustor 26 will remove heat therefrom by external convective cooling of the walls 32, 34 and 39. Similarly, the cooling air film on the sides of the walls 32, 34 and 39 fronting the annulus 38 resulting from film-like air flow into the annulus 38 through the apertures 70, 72 and 74 minimizes the heat input from the flame within the combustor 26 to the walls 32, 34 and 39.

This advantageous cooling is enhanced by reason of the jets of air which result from air flow through the apertures 70, 72 and 74 which impact upon the cooling strips to cool them. The cooling strips 86, 88 and 90 are further cooled by the aforementioned film of air flowing over them and act as a local barrier to convective and radiative heating of the walls 32, 34 and 39 by the flame burning within the combustor 26. The cooling strips 86, 88 and 90 are generally similar to one another and a complete understanding can be achieved simply from understanding the operation of one such as the cooling strip 86.

Figure 3:
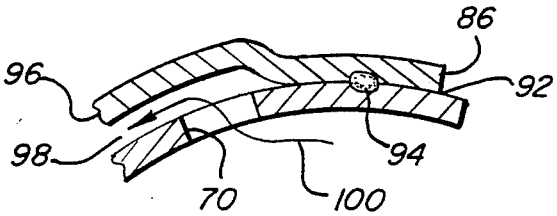
FIG. 3 is a fragmentary, enlarged sectional view of a cooling strip that may be utilized in the invention.

With reference to FIG. 3, the cooling strip 86 is seen to be in the shape of a generally flattened "S" having an upstream edge 92 bonded to the wall 32 just upstream of a corresponding row of the opening 70 by any suitable means as brazing or, for example, a weld 94. Because of the S shape of the cooling strip, this results in the opposite or downstream edge 96 being elevated above the openings 70 with an exit opening 98 being present. The exit opening 98 is elongated in the axial direction along with the edge 96 and also opens generally tangentially to the wall 32. Consequently, air entering the annulus 38 through the openings in the directions of arrows 100 (FIGS. 2 and 3) will flow in a film-like fashion in a generally tangential direction along the wall 32 and its interior surface to cool the same. The air flow indicated by arrows 102 in FIG. 2 illustrates the corresponding tangential, film-like flow of cooling air on the interior of the wall 34 while additional arrows 104 in FIG. 2 illustrate a similar, tangential film-like air flow of air entering the openings 74 in the wall 36. This means of cooling assures that all of the walls 32, 34 and 39 are covered with a cooling air film to optimize cooling. Further, the film acts to minimize carbon build-up.

In operation, fuel and air is injected generally tangentially to the annulus 38 and there will be substantial generation of turbulence at this time. The turbulence will promote uniformity of burn within the annulus 38 and this in turn will tend to provide a uniform circumferential turbine inlet temperature distribution at the nozzle 24 and at the turbine blades 22. To assure, however, that these elements, along with the shrouds 27 and 29 are suitably cooled, additional means to be described are utilized.

Figure 4:
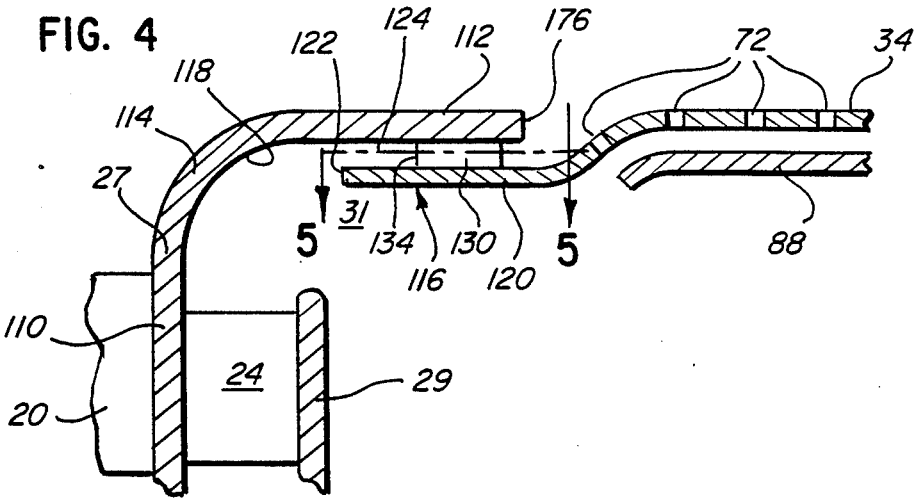
FIG. 4 is an enlarged, fragmentary sectional view of the interface of an annular combustor and a nozzle structure.

With reference to FIGS. 1 and 4, the front shroud 27 includes a generally radially extending section 110 and an outer axially extending section 112 joined by a radius 114.

At the beginning of the radius, that is, where the radius 114 joins to the axial section 112, means generally designated 116 are provided for establishing a cooling air stream or film on the inner surface 118 of the front shroud 27.

More particularly, the radially outer wall 34 includes a necked down end 120 which is telescoped within and radially spaced from the axial section 112 of the front shroud 27. The end 122 of the necked down section 120 extends to the outlet 31 and generally is in a plane at or about the beginning of the radius 118 as is clearly illustrated in FIG. 4.

As a consequence of this construction, a space 124 exists between the axial section 112 of the front shroud 27 and the necked down section 120. An end 126 of the axial section 112 is spaced from the wall 34 and thus defines an inlet 128 in fluid communication with the compressed air annulus defined by the wall 34 and the wall 44.

Figure 5:
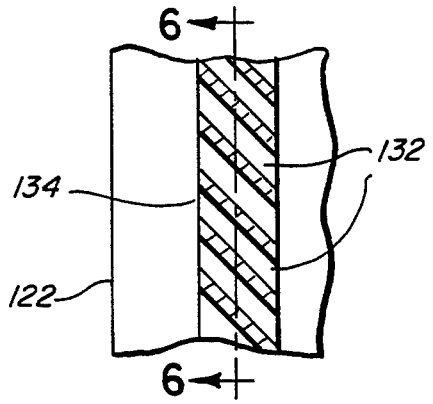
FIG. 5 is a developed sectional view taken approximately along the line 5—5 in FIG. 4.
Figure 6:
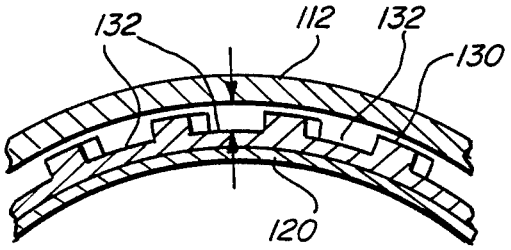
FIG. 6 is a sectional view taken approximately along the line 6—6 in FIG. 5.

Also located within the space 124 just downstream of the inlet 128 is a swirl inducing element 130. As seen in FIGS. 5 and 6, the element 130 is a circular strip having a plurality of grooves 132 located in its radially outer surface. The strip may be brazed or welded to the reduced diameter section 120 in any suitable fashion to secure the same in place. It can also be observed in FIGS. 5 and 6 that the grooves 132 are skewed axially. That is to say, they are not parallel to the rotational axis of the turbine and consequently, air passing through the grooves 132 will be caused to swirl. The grooves 132 are skewed such that the swirling motion will be in the same direction as the swirl of combustion gases, that is, in the same direction as fuel injection.

It will be observed that in the preferred embodiment the downstream end 134 of the strip is located upstream from the end 122 of the reduced diameter section 120. Thus, that part of the space 124 between the downstream end 134 of the strip 130 and the end 122 of the reduced diameter section 120 serves as an optional, but highly desirable, wake dissipating zone whereat any turbulence occurring from eddies forming as a result of that part of the strip separating the grooves 132 may dissipate so that a uniform film of air is directed at the radius 114.

Desirably, the radius 114 is relatively small, typically less than an inch in a small scale turbine.

The injection of the cooling air stream by the means just described assures that the front shroud 27 will be adequately cooled as a result of a cooling air film flowing along the surface 118. This film will also cool the junction of the front shroud 27 and the nozzle blades 24 and further, will provide cooling for the junction of the turbine blades 22 and the hub of the rotor 14.

Excellent cooling is obtained as a result of the utilization of the high centrifugal or "g" forces involved.

The cooling air entering through the grooves 132 is already swirling and thus centrifugal force tends to cause the same to hug the inner surface 118 of the front shroud 27. This centrifugal force is supplemented by the centrifugal force of the hot gases of combustion exiting the combustor via the outlet 31 radially inward of the cooling air stream. Because of the greater density of the relatively cool air as compared to the hot combustion gases, the centrifugal force will tend to keep the cooler air on the surface 118. As the cooler air impinges upon the radius 114 and is forced radially inwardly as the axial section 112 turns to the radial one 110, it will be accelerated further increasing the centrifugal force and causing the relatively cooler air to maintain film-like cooling on the surface 118 all the way radially inwardly of the nozzle vanes 24. This in turn means that the cooling air stream passes the nozzle vanes 24 and provides cooling at the junction of the blades 22 and the rotor body 14 as well.

The amount of air employed may be on the order of 6% of the total air provided by the compressor.

To obtain maximum benefit of the invention, the grooves 132 are angled so as to attain a reasonable match with the swirl angle of the hot gases of combustion as they pass through the outlet 31. Although it would be desirable that the velocity of air passing through the grooves 132 be on the order of the velocity of the hot gases, this will be difficult to obtain. The effects of any velocity mismatch can be minimized by injecting the cooling air at or near the start of the radius 114 so that the high centrifugal force effects that result stabilize the cooling air film on the interior wall 118 of the front shroud 27. At the same time, the rear shroud is cooled by compressed air from the compressor passing through the passage 30 to the outlet 31. This assures that both shrouds 27 and 29 are relatively cool so that a large temperature differential that could lead to warping or cracking cannot occur.

I claim:

1. A gas turbine comprising:

a rotor including compressor blades and turbine blades;

an inlet adjacent one side of said compressor blades;

a diffuser adjacent the other side of said compressor blades;

a nozzle including front and rear shrouds and adjacent said turbine blades for directing hot gases at said turbine blades to cause rotation of said rotor;

an annular combustor having radially inner and outer walls connected by a generally radially extending wall about said rotor and having an outlet connected to said nozzle and a primary combustion annulus defined by said walls remote from said outlet, a plurality of fuel injectors to said primary combustion annulus and being substantially equally angularly spaced therearound and configured to inject fuel into said primary combustion annulus in a nominally tangential direction; and means on said radially outer wall and at said outlet for establishing a cooling air stream on said front shroud;

said front shroud including a radial section having its outer extremity joined to an axial section by a relatively small radius, said establishing means being located at the junction of said radius and said axial section.

2. The gas turbine of claim 1 wherein said establishing means comprise a series of discharge openings in fluid communication with said diffuser and skewed axially so as to impart swirl to said cooling air stream that is in the same direction as the direction of fuel injection.

3. The gas turbine of claim 2 wherein said axial section and said radially outer wall are telescoped and radially spaced and said establishing means includes groove defining means carried by one of said axial section and said radially outer wall in the space between them, the downstream ends of said grooves defining said discharge openings.

4. The gas turbine of claim 3 wherein said groove defining means are spaced axially from said outlet to provide a wake dissipating zone between said axial section and said radially outer wall and downstream of said discharge openings.

5. A gas turbine comprising:

a rotor including compressor blades and turbine blades;

an inlet adjacent one side of said compressor blades;

a diffuser adjacent the other side of said compressor blades;

a nozzle including front and rear shrouds and adjacent said turbine blades for directing hot gases at said turbine blades to cause rotation of said rotor, said front shroud having a radial section and an axial section;

an annular combustor about said rotor and having an outlet to said nozzle, an inner wall and an outer wall spaced therefrom and a connecting radial wall, said outer wall having an outlet end telescoping with said axial section and spaced therefrom; and means at the interface of said axial section and said outer wall outlet end for injecting a swirling film of air on said front shroud.

6. The gas turbine of claim 5 wherein said sections are connected by a radius and said outlet end is radially inward of said axial section and terminates at said radius.

7. The gas turbine of claim 5 wherein said air film injection means comprises an annular array of axially skewed, elongated passages.

* * * * *